US006481685B1

(12) United States Patent
Cormier

(10) Patent No.: US 6,481,685 B1
(45) Date of Patent: Nov. 19, 2002

(54) INVERTED BOTTLE HOLDER

(76) Inventor: Kayla Cormier, 10006 Chiselhurst Way, Houston, TX (US) 77065

( * ) Notice: Subject to any disclaimer, the term of this patent is extended or adjusted under 35 U.S.C. 154(b) by 0 days.

(21) Appl. No.: 09/460,675

(22) Filed: Dec. 14, 1999

(51) Int. Cl.[7] ..... A47K 1/08

(52) U.S. Cl. ..... 248/311.3; 248/309.1; 248/311.2; 248/312; 248/314

(58) Field of Search ..... 248/311.3, 309.1, 248/311.2, 312, 314, 108, 109

(56) References Cited

U.S. PATENT DOCUMENTS 1,575,231 A * 3/1926 Seltmann
4,347,879 A * 9/1982 Blaser ..... 141/364
4,655,492 A * 4/1987 Landry ..... 294/15
4,787,337 A * 11/1988 Mayer ..... 119/18
5,065,966 A * 11/1991 Hartke ..... 248/146
5,118,012 A * 6/1992 Miller et al. ..... 222/105
5,146,957 A * 9/1992 Belokin, Jr. et al. ..... 141/1
D342,866 S * 1/1994 Lee ..... D7/619
D386,084 S * 11/1997 Marseglia ..... D9/455
5,794,904 A * 8/1998 Hackley ..... 248/311.3
D414,273 S * 9/1999 Smith et al. ..... D24/337
5,950,698 A * 9/1999 Cristea et al. ..... 141/364

* cited by examiner

*Primary Examiner*—Ramon O Ramirez
*Assistant Examiner*—Steven Marsh
(74) *Attorney, Agent, or Firm*—Lundeen & Arismendi, LLP; Andy Arismendi, Jr.

(57) ABSTRACT

The present invention relates to a new and improved apparatus for holding a bottle in an inverted position. The apparatus is comprised of a receiving end and a support frame. The receiving end is sized for receipt of the spout of the bottle therethrough and to provide resistive engagement with the bottle. The support frame is connected to the receiving end to provide stability when placed upon a surface.

5 Claims, 3 Drawing Sheets

INVERTED BOTTLE HOLDER

FIELD OF THE INVENTION

The present invention relates to a new and improved apparatus for holding a bottle or container in an inverted position. More particularly, the present invention provides an apparatus that safely and securely holds a bottle or container in an inverted position to obtain the last drop of the contents contained within. The apparatus enables the contents of the bottle or container to accumulate at the mouth of the bottle or container so that they are readily accessible upon opening of the bottle or container.

BACKGROUND OF THE INVENTION

It is often difficult to extract all of the contents of a bottle or container. Particularly, when a bottle or container contains a heavy liquid such as lotion, detergent, shampoo or glue, it is difficult to extract the last drop. Similarly, bottles containing condiments such as ketchup or mustard require considerable time and effort to empty the entirety of their contents. The difficulty of extracting the last drop of contents within a bottle or container increases as the bottles contents are depleted. The considerable time and effort required to completely empty the contents of some bottles discourages recycling, with many people choosing the trash as the easy alternative.

Several bottle holders have been developed to facilitate extraction of the contents of containers. For example, U.S. Pat. No. 5,769,280 to Ehresmann (the '280 Patent) and U.S. Pat. No. 5,664,753 to Takei (the '753 Patent) both disclose devices designed to engage the cap of a bottle to hold the bottle or container in an inverted position. The '280 Patent utilizes a resilient band which biases opposing jaws that capture the bottle cap in order to hold it in an inverted position. The '753 Patent is a holder made of resilient material which can expand slightly to receive the container cap and yet provide a tight fit in order to maintain the container in an upright condition. Both the '280 and the '753 Patents require sufficient engagement force to securely grip the cap. The engagement force can, however, damage the cap upon removal or insertion of the bottle. Further, the engagement force makes removal of the bottle or container difficult, requiring use of both hands. Additionally, because of the low-profile design of both of these Patents, the holders have to be of substantial weight when supporting long-necked or heavy bottles in order to not topple over. Thus, there is a need for an inverted bottle holder characterized by easy insertion and removal of the bottle or container and there is a need for an inverted bottle holder which is lightweight but can still support long-necked or heavy bottles.

U.S. Pat. No. 5,794,904 to Hackley (the '904 Patent) discloses an inverted bottle holder with one embodiment intended to support closed or capped bottles to collect a portion of the contents in the neck of the bottle for easy access when the bottle is opened. The holder of the '904 Patent comprises of a base and an upper portion with a spout. The base and upper portion of the '904 Patent are not integral and must be assembled prior to each use. Additionally, there exists a risk that upon removal of the bottle, the upper portion will remain affixed to the bottle either due to significant wedging resulting from use of larger or heavier bottles or due to adhesion resulting from residue from the bottle contents. There is a need, therefore, for an inverted bottle holder comprised of integral construction.

U.S. Pat. No. 5,924,659 to Babcock (the '659 Patent) discloses a grasping apparatus for grasping and holding containers of various sizes and shapes in an inverted position. The '659 Patent utilizes a pair of grasping arms selectively adjustable to grasp and hold containers of various sizes and shapes in an inverted position. However, inherent in the '659 Patent is the risk of the bottle slipping through the grasping arms, particularly in the presence of slippery residue on the outer surface of the bottle or container. It is, therefore, desirable to invert a bottle without the risk of slipping.

U.S. Pat. No. 5,702,009 to Ouellet et al. (the '009 Patent) discloses an inverted bottle holder that overcomes several of the problems of the aforementioned prior art. The '009 Patent discloses a cube-shaped hollow body having a sidewall on each of five sides defining a cavity which is open at a sixth side. Several of the sidewalls have different sized apertures capable of holding the neck of particular sized bottles. The '009 Patent discloses a simple one piece design which allows for easy insertion and removal of the bottle or container, can support various sized bottles, and avoids risks associated with slipping. However, the overall bulk of the cube-shaped design acts as an impediment to efficient storage (i.e. in refrigerators, cabinets, etc.).

SUMMARY OF THE INVENTION

The present invention relates to a new and improved apparatus for holding a bottle in an inverted position. The bottle, or container, typically has either a spout and a shoulder or a tapered neck. In a preferred embodiment of the present invention, the apparatus is comprised of a cylindrical receiving end and a cylindrical support frame. The cylindrical receiving end is sized for receipt of the spout of the bottle therethrough and to provide resistive engagement with the bottle. The cylindrical support frame is integrally connected to the cylindrical receiving end.

In an alternate preferred embodiment of the present invention, the apparatus is again used for holding a bottle in an inverted position. The bottle held in the inverted position has a spout or a tapered neck. The apparatus is comprised of a receiving end, a frame, and support legs. The receiving end has an inside diameter defining an aperture sized for receipt of the spout or neck of the bottle and for restrictive engagement with the bottle to resist further movement of the bottle through the apparatus. The frame of the apparatus, which connects the receiving end to the support legs, has an interior surface defining a cavity in communication with the aperture of the receiving end. The cavity is sized for receipt of the spout of the bottle. The support legs provide structural stability to the apparatus.

In another preferred embodiment of the present invention, the apparatus is comprised of a receiving end, a frame, and a lower body. The receiving end, which has an inside and an outside diameter, is comprised of an aperture and a collar. The aperture is defined by the inside diameter of the receiving end and is sized for receipt of the spout or neck of the bottle therethrough. The collar is comprised of a restrictive surface defined by the inside and outside diameter of the receiving end. The restrictive surface of the collar is for engagement with the shoulder of the bottle to resist further movement of the bottle through the apparatus. The frame of the apparatus, which is integrally connected to the receiving end has an interior surface and an exterior surface. The interior surface of the frame defines a cavity in communication with the aperture. The cavity is sized for receipt of the spout of the bottle. The exterior surface of the frame is suitable for grasping. The lower body of the apparatus is integrally connected to the frame. The lower body is comprised of support legs and flexing joints. The flexing joints provide rigid support to the legs while being able to flex slightly to accommodate varying bottle shapes and sizes.

It is therefore a feature of the present invention to provide an apparatus for holding a bottle in an inverted position which is lightweight, enables easy insertion and removal, and can accommodate a wide range of bottle shapes and sizes. It is a further feature of the present invention to provide an inverted bottle holder comprising of one piece construction for ease of manufacturing and use. It is a further feature of the present invention to provide an inverted bottle holder which prevents the bottle from slipping through the apparatus and which prevents the apparatus from slipping from the user's grasp. It is still another feature of the present invent ion to provide an inverted bottle holder which is not bulky and enables efficient storage within cabinets, refrigerators, closets, etc.

Other features, and the advantages, of the present invention will be made clear to those skilled in the art by the following detailed description of the preferred embodiments constructed in accordance with the teachings of the present invention.

DESCRIPTION OF THE PREFERRED EMBODIMENTS

The following detailed description illustrates the invention by way of example and not by way of limitation. The present invention provides an apparatus for holding a bottle or container in an inverted position. While inverted, the contents of the bottle or container accumulate at its mouth so that they are readily accessible upon opening of the bottle or container. It should be noted that the present invention is capable of supporting bottles and containers including, but not limited to, condiment bottles, glue containers, liquid detergent containers, liquid soap containers, shampoo bottles, paint containers, etc. In the following detailed description, for convenience purposes, the inverted bottle holder is described with reference to bottles only. However, one skilled in the art will recognize the multiplicity of bottles and containers for which the present invention is useful.

Figure 1:
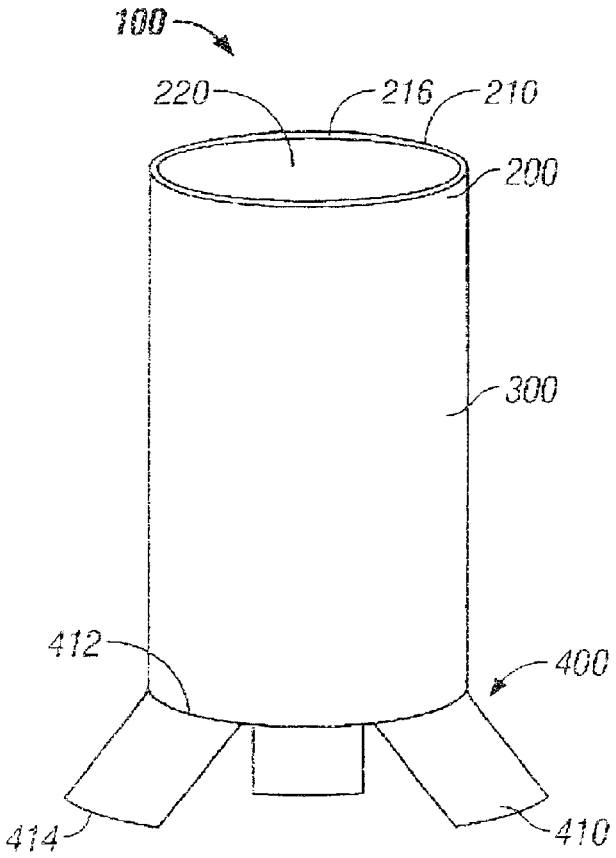
FIG. 1 is a perspective view of a preferred embodiment of the present invention.
Figure 2:
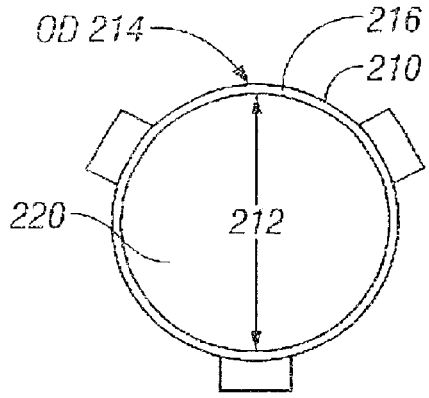
FIG. 2 is a top plan view of the a preferred embodiment of the present invention illustrated in FIG. 1.

FIGS. 1 and 2 show a preferred embodiment of the present invention in perspective and top plan views, respectively. The inverted bottle holder, indicated generally as 100, of the preferred embodiment of the present invention comprises a receiving end 200, a frame 300, and a lower body 400. In the preferred embodiment of the present invention, the components are preferably constructed from a metallic mesh material which is lightweight and provides rigid support while being able to flex slightly to accommodate varying bottle shapes and sizes. One skilled in the art will recognize, however, that embodiments comprised of other materials still fall within the purview of the invention. For example, although limiting the scope of its use, the inverted bottle holder could be comprised of a rigid material and still remain consistent with the intended invention.

The receiving end 200 of the preferred embodiment of the present invention is comprised of a collar 210 and an aperture 220. The surface 216 of the collar 210 is defined by the interior diameter 212 and the outer diameter 214 of the receiving end 200. The surface 216 provides support for an inverted bottle 500 (shown in FIGS. 3 and 4). It should be noted that although in the preferred embodiment of the present invention the collar 210 is comprised of metallic mesh, in an alternative embodiment, the collar 210 can be coated or be comprised of a soft ring designed to hold the bottle 500 in place without scratching the surface of the bottle 500. The materials useful for the collar 210 coating or collar 210 may be material such as natural rubber or a synthetic polymer. The synthetic polymer preferably being thermoplastic polymer, more preferably being an elastomer. The interior diameter 212 of the receiving end 200 further defines an aperture 220, which is sized for receipt of the spout or neck 510 (shown in FIGS. 3 and 4) of the bottle 500.

Figure 3:
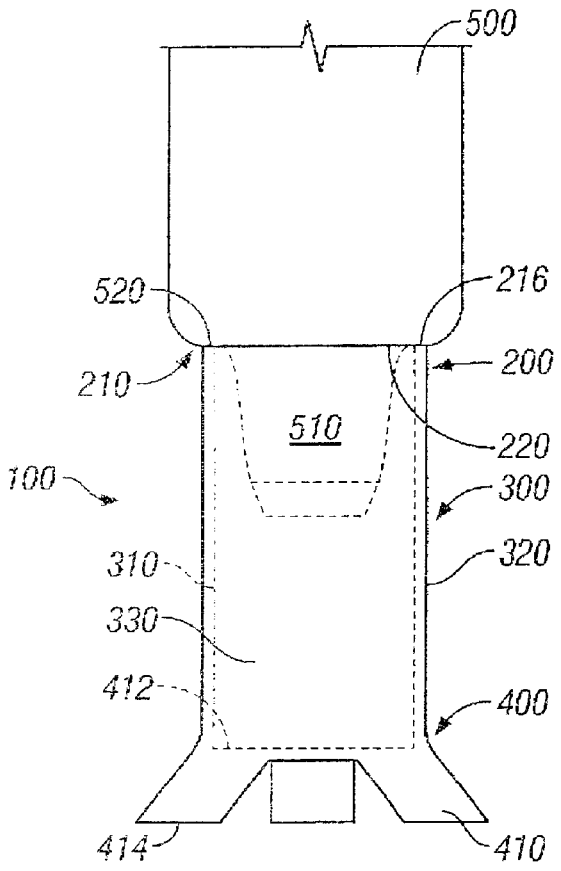
FIG. 3 is a side plan view of a preferred embodiment of the present invention shown i n use with a bottle having a neck and a shoulder.
Figure 4:
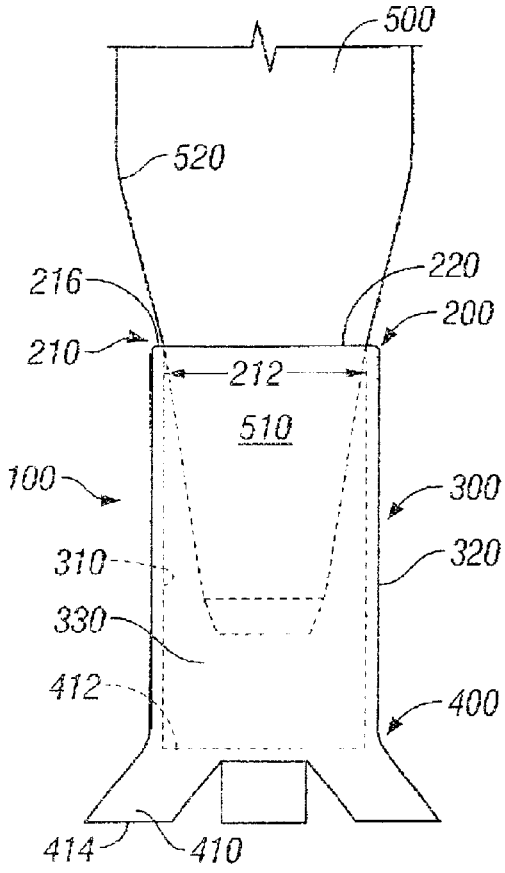
FIG. 4 is a side plan view of a preferred embodiment of the present invention shown in use with a bottle having a long tapered neck and no clearly defined shoulder.
Figure 5:
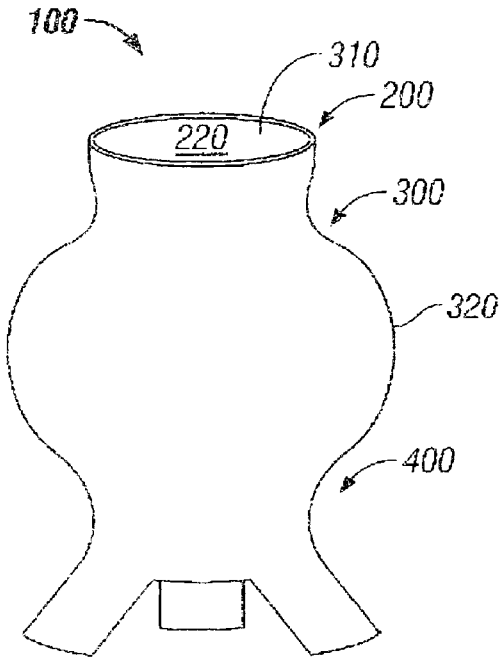
FIG. 5 is a perspective view of a preferred embodiment of the present invention in which the interior surface of the frame is decoratively shaped.

The frame 300 of the preferred embodiment of the present invention connects the receiving end 200 to the lower body 400. As best shown in FIGS. 3 and 4, the interior surface 310 of the frame 300 defines a cavity 330 which is sized for receipt of a spout or neck 510 of a bottle 500. In the preferred embodiment of the present invention, the inside diameter of the interior surface 310 is equal in dimension to the aperture 220. However, one skilled in the art will recognize that the interior surface 310 of the frame 300 can have any size and shape as long as is remains capable of receipt of the neck 510 of the bottle 500. For example, FIG. 5 shows an alternative embodiment of the present invention in which the interior surface 310 of the frame 300, and thus the cavity 320 of the frame 300, is decoratively shaped. Alternatively, the frame 300 can be shaped to facilitate efficient storage within a cabinet or refrigerator. Thus, the interior surface 310 of the frame 300 can have a multiplicity of sizes and shapes and remain within the purview of the invention.

Figure 6:
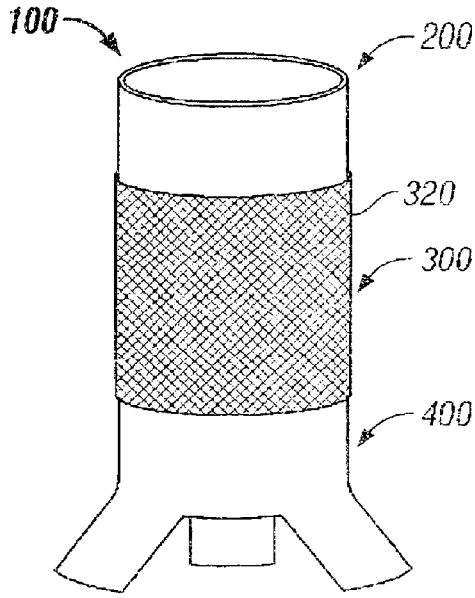
FIG. 6 is a perspective view of a preferred embodiment of the present invention which is constructed with alternate materials and the exterior surface of the frame is coated with a slip resistant material.

In the preferred embodiment of the present invention, the exterior surface 320 of the frame 300 is comprised of a metallic mesh material. The mesh material enables easy gripping of the present invention without the risk of the inverted bottle holder slipping from the grasp. Alternatively, as shown in FIG. 6, where the present invention is constructed of alternate materials, the exterior surface 320 can be coated or covered with a slip resistant material and still remain within the purview of the invention.

Figure 7:
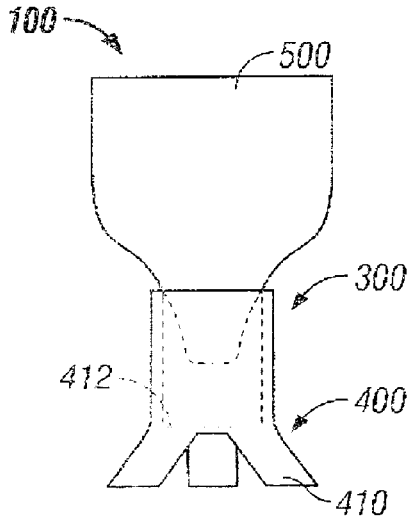
FIG. 7 is a side plan view of a preferred embodiment of the present invention in which the support legs are able to flex slightly under significant weight.
Figure 8:
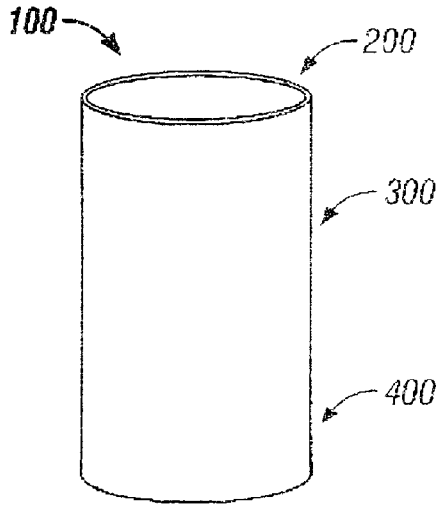
FIG. 8 is a perspective view of another preferred embodiment of the present invention in which the lower body comprises a single uniform base.

Referring back to FIGS. 1 and 2, the lower body 400 of the preferred embodiment of the present invention is illustrated. The lower body 400 comprises of legs 410 affixed to the frame 300 at a flexing joint 412. The flexing joint 412 provides rigid support to the legs 410 while being able to flex slightly to accommodate varying bottle shapes and sizes. For example, the legs 410 can be bent outwardly or inwardly to raise or lower the overall height of the bottle holder. Further, as shown in FIG. 7, when a bottle 500 of significant weight is supported, the legs 410 are able to flex slightly outward to provide a more stable base support. It should be noted that while the preferred embodiment of the present invention illustrates three legs 410, one skilled in the art will recognize that any number of legs may be utilized and still fall within the purview of the invention. It should also be noted that it is not necessary for the legs 410 to flex to remain within the scope of the invention. If the holder is constructed of rigid materials, an obvious consequence is that the legs will not flex. Additionally, in an alternative embodiment shown in FIG. 8, the lower body 400 comprises a single uniform base.

Referring back to FIGS. 1 and 2, the ends of the legs 410 opposite the flexing joint 412 are comprised of a gripping surface 414. In the preferred embodiment, the gripping surface 414 is comprised of the metallic mesh, which comprises the entire structure. However, in alternative embodiments, the gripping surface 414 is comprised of suitable material to prevent sliding across surfaces such as tables, cabinets, etc., but soft enough to prevent scratching of the same aforementioned surfaces. As such, the gripping surface 414 can be coated by suitable material or comprised of an alternative material that provides friction resistance to sliding without marring or scratching surfaces. Such materials may be natural rubber or synthetic polymers having a high coefficient of friction relative to common household kitchen surfaces, e.g., formica, ceramic stone, and stainless steel.

Referring to FIGS. 3 and 4, examples of use are illustrated. FIG. 3 is a plan view of a preferred embodiment of the present invention shown in use with a bottle 500 having a neck 510 and a shoulder 520. The aperture 220 of this preferred embodiment is sized to receive the neck 510 of the bottle 500 but not the shoulder 520 of the bottle 500. As the bottle 500 is inserted into the preferred embodiment of the present invention, the shoulder 520 contacts the surface 216 of the collar 210 and is prevented from further downward movement. FIG. 4 illustrates in plan view the preferred embodiment of the present invention in use with a bottle 500 having a long tapered neck 510 and no clearly defined shoulder. As the bottle 500 is inserted into the bottle holder 100, the collar 210 engages and prevents further movement of the tapered neck 510 when the outer dimension 512 of the neck 510 is equal to the interior diameter 212 of the collar 210. The above examples are for illustration purposes only and should not be construed as the only types of bottles 500 suitable for use by the present invention. One skilled in the art will recognize that the preferred embodiment of the present invention can be manufactured in a wide variance of sizes to accommodate bottles 500 of different shapes and sizes.

Figure 9:
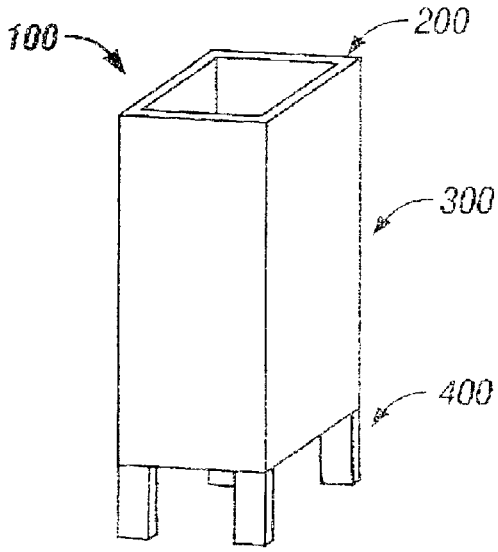
FIG. 9 is a perspective view of a preferred embodiment of the present invention in which the components are rectangular.

Although described in terms of the preferred embodiments shown in the figures, those skilled in the art who have the benefit of this disclosure will recognize that changes can be made to the individual component parts thereof which do not change the manner in which those components function to achieve their intended result. For example, it is not necessary that the receiving end 200 and frame 300 be substantially cylindrical. The size and shape of the receiving end 200 and frame 300 can be any suitable size and shape for receipt of a bottle 500. For example, FIG. 9, shows an alternative embodiment in which the receiving end 200 and frame 300 are substantially rectangular. Such modifications, as well as others discussed above, are changes that are intended to fall within the scope of the following non-limiting claims.

I claim:

1. An apparatus for use in holding a bottle in an inverted position, the bottle having a spout and a shoulder, the apparatus comprising:

a) a receiving end having an inside diameter and an outside diameter, the receiving end comprised of an aperture and a collar, the aperture defined by the inside diameter of the receiving end and sized for receipt of the spout of the bottle therethrough, the collar comprised of a restrictive surface defined by the inside and outside diameter of the receiving end, the restrictive surface for engagement with the shoulder of the bottle to resist further movement of the bottle through the apparatus;

b) a frame integrally connected to the receiving end, the frame having an interior surface and an exterior surface, the interior surface defining a cavity in communication with the aperture, the cavity sized for receipt of the spout of the bottle, the exterior surface suitable for grasping; and c) a lower body integrally connected to the frame, the lower body comprised of support legs and flexing joints, the flexing joints providing rigid support to the legs while being able to flex slightly to accommodate varying bottle shapes and sizes.

2. The apparatus of claim 1, wherein the collar is coated with a material suitable to prevent scratching the surface of the bottle.

3. The apparatus of claim 1, wherein the collar is comprised of a ring affixed to the receiving end, the ring being comprised of material suitable to prevent scratching the surface of the bottle.

4. The apparatus of claim 1, wherein the interior surface and the exterior surface of the frame are decoratively shaped.

5. The apparatus of claim 1, wherein the support legs additionally comprise a slip-resistant coating.

* * * * *